US009888748B2

(12) United States Patent
Smith

(10) Patent No.: US 9,888,748 B2
(45) Date of Patent: Feb. 13, 2018

(54) ZIP FASTENER

(71) Applicant: J & P COATS LIMITED, Uxbridge, Middlesex (GB)

(72) Inventor: Steven Smith, Peterlee (GB)

(73) Assignee: J & P COATS LIMITED, Uxbridge (GB)

( * ) Notice: Subject to any disclaimer, the term of this patent is extended or adjusted under 35 U.S.C. 154(b) by 67 days.

(21) Appl. No.: 14/817,641

(22) Filed: Aug. 4, 2015

(65) Prior Publication Data

US 2016/0037872 A1 Feb. 11, 2016

(30) Foreign Application Priority Data

Aug. 5, 2014 (GB) ..... 1413831
Sep. 3, 2014 (GB) ..... 1415592

(51) Int. Cl.
*A44B 19/34* (2006.01)
*A44B 19/32* (2006.01)
*D03D 1/00* (2006.01)

(52) U.S. Cl.
CPC ..... *A44B 19/346* (2013.01); *A44B 19/32* (2013.01); *D03D 1/00* (2013.01); *A44B 19/343* (2013.01); *Y10T 24/252* (2015.01); *Y10T 24/2521* (2015.01)

(58) Field of Classification Search
CPC ..... Y10T 24/2521; Y10T 24/2523; Y10T 24/252; A44B 19/32; A44B 19/346; A44B 19/34; A44B 19/343
USPC ..... 139/384 B
See application file for complete search history.

(56) References Cited

U.S. PATENT DOCUMENTS 4,596,065 A * 6/1986 Tanikawa ..... A44B 19/32 29/33.2
5,172,456 A 12/1992 Samberg et al.
6,105,214 A 8/2000 Press
2002/0100148 A1 8/2002 Tominaga et al.
2002/0184926 A1 12/2002 Matsuda
2004/0111842 A1* 6/2004 Imai ..... A44B 19/34 24/381

(Continued)

FOREIGN PATENT DOCUMENTS

DE 25 00 924 A1 7/1976
GB 1 450 162 A 9/1976

OTHER PUBLICATIONS

Dec. 11, 2015 Office Action issued in extended European search report EP 15 00 2316.

(Continued)

*Primary Examiner* — Robert Sandy
*Assistant Examiner* — Michael S Lee
(74) *Attorney, Agent, or Firm* — Oliff PLC

(57) ABSTRACT

A zip includes: a pair of stringer tapes, each of which supports a row of teeth; the teeth on the two tapes being mutually opposing and capable of interdigitation thereby to fasten one stringer tape to another; a slider, adapted to move along and whose motion is guided by the rows of teeth, the slider being adapted to cause interdigitation of the teeth as a result of motion along the teeth in a first direction, and to disconnect the teeth by motion along the teeth in a second direction; wherein the first and second stringer tapes are formed of a matrix of threads interspersed with a waterproof material.

12 Claims, 4 Drawing Sheets

(56) References Cited

U.S. PATENT DOCUMENTS

| | | | | |
|---|---|---|---|---|
| 2005/0235466 | A1* | 10/2005 | Segawa | A44B 19/34 24/396 |
| 2008/0257442 | A1* | 10/2008 | Horikawa | A44B 19/346 139/384 B |
| 2013/0185903 | A1 | 7/2013 | Matsuzawa et al. | |
| 2014/0223699 | A1* | 8/2014 | Tsuzuyama | A44B 19/343 24/381 |

OTHER PUBLICATIONS

Dec. 11, 2015 Extended Search Report issued in European Patent Application No. 15002316.6.

* cited by examiner

ZIP FASTENER

The present invention relates to a zip fastener which may be used, for example, in circumstances where a waterproof closure is required.

be used on waterproof garments. One example of such a zip fastener can be found in U.S. Pat. No. 6,105,214 U.S. Pat. No. 4,596,065 and U.S. Pat. No. 6,105,214, each of which discloses the use of a supplementary polyurethane or other layer adhered to the stringer tape of the zip. It is also known to provide zip fasteners on fire-retardant garments.

The present invention is set out in the claims

Embodiments of the present invention will now be described, by way of example, and with reference to the accompanying drawings, in which.

Figure 2:
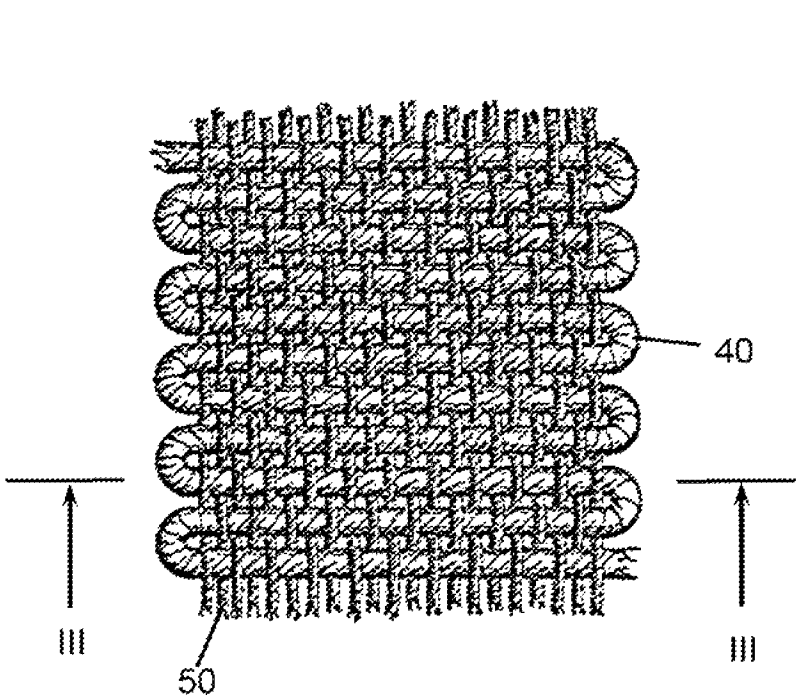
FIG. 2 is a detail of the weave of the stringer tape used the embodiment of zip of FIG. 1.
Figure 1:
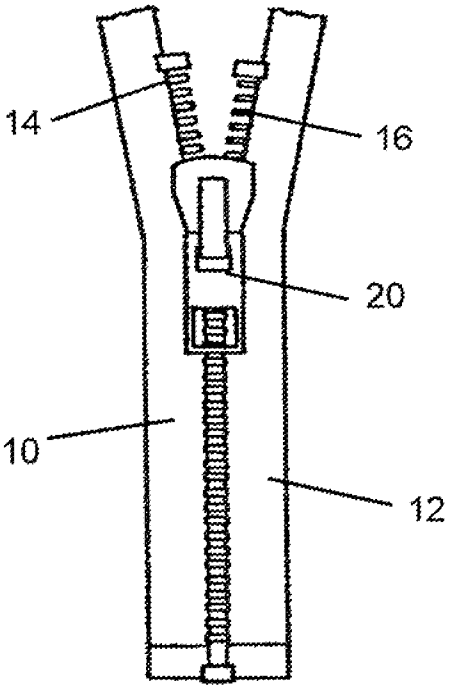
FIG. 1 is a plan view of a zip according to an embodiment of the present invention.

Referring now to FIGS. 1 and 2, a zip comprises a pair of stringer tapes 10, 12, each of which supports a row of teeth 14, 16 respectively. The teeth on the two tapes are mutually opposing and, as is known, are capable of interdigitation by means a slider 20. The slider 20 is adapted to move along and be guided by the rows of teeth 14, 16. The slider 20 causes interdigitation of the teeth 14, 16 as a result of motion along the teeth in a first direction F1 which therefore then serves to fasten the stringer tapes (and any fabric panel to which they may be connected) to each other along the entirety of their length. The slider is adapted to extradigitate, and therefore to disconnect the teeth 14, 16 by motion along the teeth in the opposite direction. Thus far, the zip as described is known.

In accordance with one embodiment of the present invention, the stringer tapes 14, 16 are formed from a matrix of filaments into which is interspersed a material having a particular characteristic which matches that of the garment on which the zip fastener is used. Such a characteristic may, for example, be impermeability to water ('waterproof material'); or fire retardant material. Generically, such materials will be referred to herein as a native material, that is to say a material having the characteristic native to the characteristic of the web of fabric to which the stringer tape is attached (i.e. fire retardant where the zip fastener is used on fire-retardant garments, waterproof where the zip fastener is used on waterproof garments, and so on).

Referring now to FIG. 2, in one embodiment where the native characteristic is waterproof the native material is waterproof material. The matrix created by weaving yarns which are formed from higher and lower melting-point filaments plied with each other. Thus, each of the yarns forming the weft yarn 40 and the warp yarns 50 comprises a combination of plied yarns, at least one of which comprises filaments which are thermofusible at a particular (relatively low) temperature (thermofusible filaments or thermofusible elements) and at least a further one of which is a 'carrier' or 'supporting' ply which is made of filaments having a higher melting point (standard filaments). When heat is applied to the tape, and thus yarn used to weave the tape, the thermofusible filaments and therefore the thermofusible ply of each yarn melts and pervades through a woven matrix of carrier plies. The result is a woven matrix of carrier yarn provided by the weft and warp carrier yarn which retains and supports a native, waterproof material provided by the melted, distributed material 56 previously (i.e. prior to heat treatment) forming the thermofusible plies, as is illustrated in the section view of FIG. 3.

The yarns made to weave the stringer taples 10, 12 may be of any suitable configuration. According to one embodiment, the different plies (thus at least one thermofusible ply and at least one carrier ply) of the yarns may be plied in a traditional manner by twisting them around each other in an anti-clockwise direction (an S twist) or a clockwise direction (a Z twist). Where the individual plies are multfilament, the individual filaments of those plies are typically twisted in the opposite direction to the ply direction to counteract the torque and provide a plied thread which is torque neutral, or nearly torque neutral.

Alternatively, where there are three plies, the or each carrier ply and the or each thermofusible ply may be braided. One preferred embodiment comprises a single carrier ply and two thermofusible plies.

Figure 4:
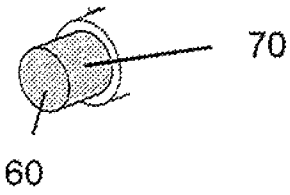
FIG. 4 is a detail of one yarn construction used to weave stringer tapes of the zip of FIG. 1.
Figure 6:
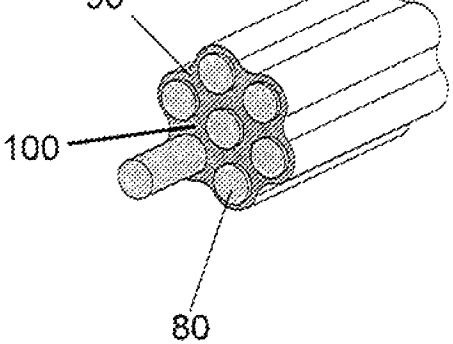
FIGS. 5 and 6 are perspective views of yarn used in the stringer tapes of FIGS. 1 and 4.
Figure 5:
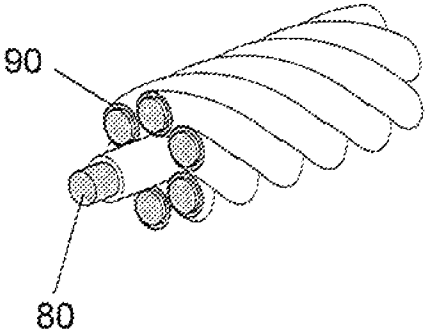

Referring now to FIG. 4, in yet a further embodiment, the plies each comprise a central core of carrier yarn 60 coated in a sheath 70 of thermofusible material. These may be plied together in the manner discussed above by twisting them around each other or braiding. Alternatively, referring now to FIGS. 5 and 6, the plies may be configured with a central ply 80 around which are twisted a plurality (in the embodiment of FIGS. 5 and 6, the number is six) peripheral plies 90 which effectively wrap the central ply. When heat is applied to melt the thermofusible element the result is a relatively solid central core ply 80 and peripheral plies 90 which are interspersed by thermofusible material 100. Typically, in such an embodiment, the central ply will have a higher grist than the peripheral ones.

In one embodiment of stiffening thread according to the present invention, the thermofusible material (whether in a separate ply or integrated as a sheath around a core carrier yarn) has a melting point between 70 and 150° C. and the carrier ply has a melting point above 150° C. Preferably, where the thermofusible material is a separate ply it is a monofilament ply though multifilament may also be used. In one preferred embodiment the thermofusible ply or sheath is of polyamide having a melting point of 110° C. In an alternative embodiment, the thermofusible plies or sheaths have a melting point of 85° C.

Figure 3:
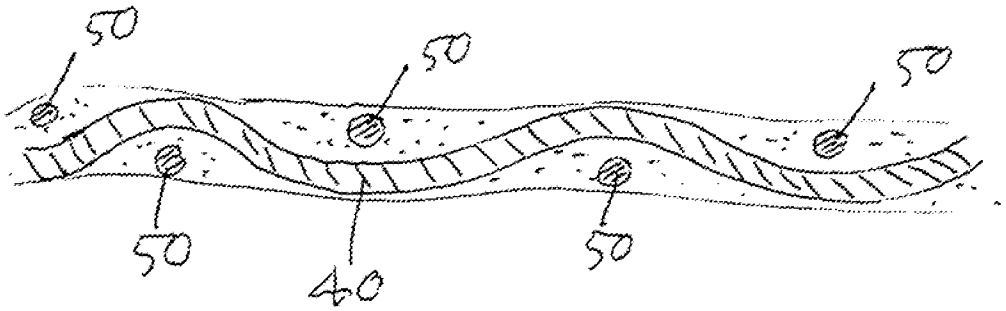
FIG. 3 is a section through III-III in FIG. 2.

For all preferred embodiments of yarn construction used to weave the stringer tapes, once heat is applied to the resultant stringer tape, as illustrated in the embodiment of FIG. 3, is a matrix of carrier yarns interspersed with reformed thermofusible material that is made of a material that is insoluble in and impenetrable to water. Consequently the stringer tapes 10, 12 acquire a waterproof characteristic.

Attachment of the stringer tapes to a fabric panel can be by any suitable means, including stitching or gluing. For certain applications, however, it may be found that the waterproof medium interspersing the matrix causes some difficulty in stitching. Where this is found to be the case this difficulty can be overcome by reducing the proportion of waterproof medium in that part of the matrix where the stitching is to be performed. This has been found not greatly to impair the waterproofing since the fabric panels being stitched to the stringer tape in this region will typically be of waterproof material and will be stitched with a thread enabling waterproofing of the stitching.

Figure 8:
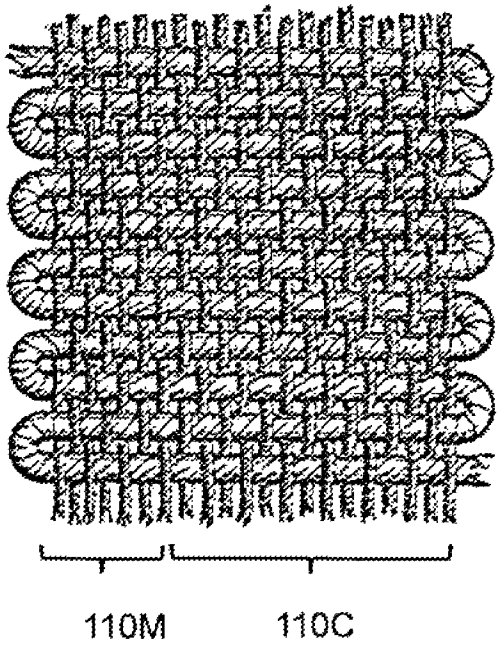
FIG. 8 is a detail of the stringer tape of the zip of FIG. 7.
Figure 7:
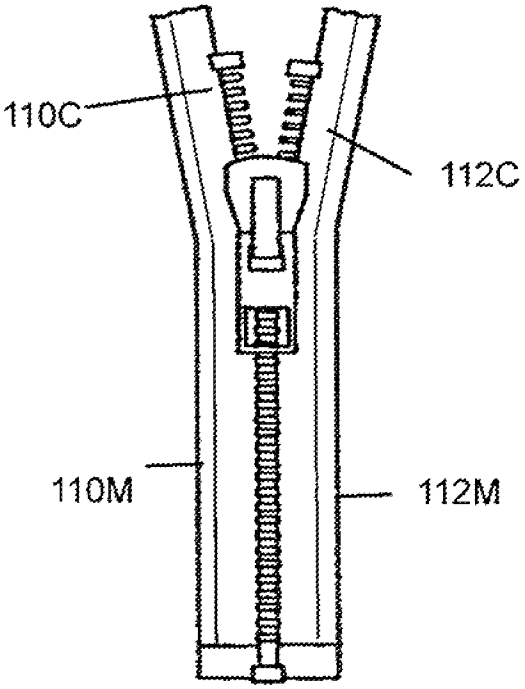
FIG. 7 is a plan view of a further embodiment of zip in accordance with the present invention.

Referring now to FIGS. 7 and 8, the stringer tapes 110, 112 each have an outer margin 110M, 112M respectively with approximately half of the waterproof material of the central part 110C, 112C respectively of each respective tape. Referring additionally to FIG. 8, in one embodiment, this is achieved by a differential weave. In the central regions 110C, 112C, both the weft and the warp yarns are of combination construction, i.e. comprise both thermofusible and non-thermofusible elements. By contrast, in the margin areas, 110M, 112M, the warp yarns do not comprise any thermofusible element with the result that the concentration of waterproof material after melting in those regions is reduced by comparison to 110C, 112C.

In a further embodiment, the stringer tapes are woven from normal, ordinary yarns which do not include any thermofusible material and, subsequent to weaving are impregnated with a flexible, waterproof material such as silicone (though a heated thermofusible material may equally be used.

In yet a further embodiment, the stringer tapes are made of 'non-woven' web material. In one embodiment, this may be created by, for example, the provision of a large number of relatively short lengths of thermofusible materials which are then compressed into a planar web and heat is applied to them. Alternatively, the web may be made in the manner of a standard, 'felted' non-woven material and impregnated with waterproof material such as silicone in the manner described above. Selective or differential impregnation is also possible to take account of the stitching requirements where fabric panels are to be stitched to the stringer tapes.

The present embodiments have a number of advantages over prior art waterproof zips. Firstly, the waterproof zips which include a distinct waterproof (e.g. polyurethane) layer adhered to the stringer tapes are available in a range of colours limited by reference to the colours in which the waterproof layers are available. In contrast, the stringer tapes of the present invention may be dyed in the same manner as existing stringer tapes and so are available in any colour. Further, garments manufactured with zips according to embodiments of the present invention may be made in the normal way, since the zip may be treated as a normal zip. In addition, zips according to embodiments of the present invention are less susceptible to degradation of waterproof performance due to wear caused by movement of the slider than the corresponding polyurethane-layer coated zips. A further advantage is that the manufacture of zips according to embodiments of the present invention is inherently less wasteful of materials.

Further embodiments of the invention include a method wherein the peripheral yarns comprise core of standard material filaments wrapped in a sheath of thermofusible material; a method wherein the combination yarns comprise distinct standard and filaments having native characteristics plied together. Yet further embodiments include a garment including a fabric panel having a material with a native characteristic and a zip fastener as claimed in the accompanying claims; and a garment wherein the native characteristic is selected from the group consisting of waterproof and fire retardant.

According to further embodiments of the present invention, zips manufactured using bicomponent yarn may include patterns woven into the stringer tape (for example with different coloured yarns) which patterns are then protected by means of the thermofused material dispersed through the matrix of woven or non-woven fibres forming the stringer tape.

According to yet a further embodiment, the native material's characteristic is fire-retardancy. In this embodiment, bicomponent yarn is used on fire-retardant garments where the yarns used to create the stringer tapes may include a thermofusible ply or plies which have relatively high melting points and used with yarns having higher melting points such as p-aramid which are thermofusible at high temperatures to provide a zip whose performance matches or approaches the fire retardance of the garment on which it is employed.

According to yet a further embodiment, the use of a stringer tape including bicomponent yarns can be employed with a smaller proportion of thermofusible material present; in one embodiment bicomponent yarns are used only at the outer margins of the tapes to prevent fraying; or alternatively (or in addition) at the inner edges to reinforce the part of the tape to which end components are attached, for example.

In yet further embodiments, bi-component yarn made of native material which can be interspersed within the matrix of threads upon the application of other activating mechanisms (i.e. other than heat) can be used. Thus, bi-component yarn including native material which is dispersed upon the use of a certain activating chemical, or other physical conditions may be used.

The invention claimed is:

1. A zip fastener for use in conjunction with a material having a native characteristic being water-resistance or fire retardancy, the zip fastener comprising:

a pair of stringer tapes, each of which supports a row of teeth;

the teeth on each tape being mutually opposing and capable of interdigitation thereby to fasten one tape to another;

a slider, adapted to move along the rows of teeth and whose motion is guided by the teeth, the slider being adapted to cause interdigitation of the teeth as a result of motion along the teeth in a first direction, and to cause extradigitation of the teeth by motion along the teeth in a second direction;

wherein the first and second stringer tapes are formed of a matrix comprising warp and weft woven threads, wherein the warp and weft woven threads are each formed of a combination yarn comprising at least two plies, one ply comprising filaments having the native characteristic of the material.

2. A zip according to claim 1 wherein the matrix is formed by weaving at least one combination yarn comprising a combination of native material which is fusible above a predetermined temperature ('thermofusible material') and material which is not fusible at the predetermined temperature ('standard material') and applying heat to the stringer tape above the predetermined temperature thereby to melt the thermofusible material.

3. A zip according to claim 1 wherein the matrix comprises a first region in which all warp yarns are combination yarns including native material and a second region in which warp yarns are made of filaments which include no native material.

4. A zip according to claim 3 wherein the warp yarns extend substantially parallel to the rows of teeth.

5. A zip according to claim 4 wherein the second region is located on the opposing side of the respective stringer tapes from the teeth.

6. A zip according to claim 1 wherein the zip teeth are provided by a pair of continuous elements coiled around the respective edges of the stringer tapes.

7. A zip according to claim 1 wherein the native material is waterproof material, provided by silicone.

8. A zip according to claim 1 wherein the native material is fire-retardant material.

9. A method of manufacturing a zip comprising the steps of:

creating a pair of stringer tapes by weaving a weft yarn being a combination yarn comprising a ply of thermofusible material with at least one warp yarn being a combination yarn comprising a ply of thermofusible material;

attaching a row of zip teeth to an edge of each stringer tape;

attaching a zip slider to the stringer tapes such that the zip teeth of the stringer tapes oppose each other and the slider moves along the zip teeth to fasten and unfasten the zip; and applying heat to the stringer tapes thereby to melt the thermofusible filaments.

10. A method according to claim 9 wherein the individual yarns comprise a core yarn and a plurality of peripheral yarns wrapped around the core yarn, and wherein at least the core yarn comprises a core of standard material filaments in a sheath of native material.

11. A method according to claim 10 wherein the native material is thermofusible material.

12. A zip according to claim 1 wherein the matrix is formed of warp and weft combination yarns each having a ply comprising thermofusible filaments thereby to provide a waterproof characteristic to the stringer tapes.

* * * * *